US011898573B2

(12) United States Patent
Li et al.

(10) Patent No.: US 11,898,573 B2
(45) Date of Patent: Feb. 13, 2024

(54) CENTRIFUGAL FAN AND CLOTHING DRYER

(71) Applicants: QINGDAO HAIER DRUM WASHING MACHINE CO., LTD., Qingdao (CN); Haier Smart Home Co., Ltd., Qingdao (CN)

(72) Inventors: Tao Li, Qingdao (CN); Peishi Lv, Qingdao (CN); Jindong Bing, Qingdao (CN); Rongfeng Cheng, Qingdao (CN); Long Yang, Qingdao (CN)

(73) Assignees: QINGDAO HAIER DRUM WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 204 days.

(21) Appl. No.: 17/613,618

(22) PCT Filed: May 13, 2020

(86) PCT No.: PCT/CN2020/090027
§ 371 (c)(1),
(2) Date: Nov. 23, 2021

(87) PCT Pub. No.: WO2020/233470
PCT Pub. Date: Nov. 26, 2020

(65) Prior Publication Data

US 2022/0235791 A1 Jul. 28, 2022

(30) Foreign Application Priority Data

May 23, 2019 (CN) ..... 201910436579.9

(51) Int. Cl.
*F04D 29/28* (2006.01)
*D06F 58/20* (2006.01)
(Continued)

(52) U.S. Cl.
CPC ..... *F04D 29/281* (2013.01); *D06F 58/20* (2013.01); *F04D 17/08* (2013.01); *F04D 29/4226* (2013.01)

(58) Field of Classification Search
CPC .... F02D 29/281; F02D 17/08; F02D 29/4226; F02D 29/422; F02D 29/464;
(Continued)

(56) References Cited

U.S. PATENT DOCUMENTS

938 A * 9/1838 McCord ..... F04D 29/281 416/182
107,665 A * 9/1870 Colwell ..... F04D 29/4226 55/467
(Continued)

FOREIGN PATENT DOCUMENTS

CN 203285738 U 11/2013
CN 105987024 A 10/2016
(Continued)

OTHER PUBLICATIONS

International Search Report dated Aug. 19, 2020 in corresponding International application No. PCT/CN2020/090027; 6 pages.

*Primary Examiner* — Phutthiwat Wongwian
*Assistant Examiner* — Susan E Scharpf
(74) *Attorney, Agent, or Firm* — Maier & Maier, PLLC

(57) ABSTRACT

A centrifugal fan and a dryer, where the centrifugal fan includes a shell, a driving mechanism, an impeller and a volute tongue arranged in the shell, the driving mechanism is connected with the tongue and can drive the tongue to rotate between a first limit position and a second limit position, the tongue includes a first volute tongue part and a second volute tongue part; when the tongue is located at the first limit position and the impeller rotates forwards, the first tongue part abuts against the inner wall of one side of the shell in a sealed mode, the second tongue part can cut the air
(Continued)

blown by the impeller, and when the tongue is located at the second limit position and the impeller rotates reversely, the first tongue part can cut air blown by the impeller.

10 Claims, 4 Drawing Sheets

(51) Int. Cl.
*F04D 17/08* (2006.01)
*F04D 29/42* (2006.01)

(58) Field of Classification Search
CPC ..... F02D 29/483; F02D 29/282; F02D 17/16; F02D 25/08; F02D 29/462; D06F 58/20; F04D 29/281; F04D 17/08; F04D 29/4226; F04D 29/422; F04D 29/464; F04D 29/483; F04D 29/282; F04D 17/16; F04D 25/08; F04D 29/462; F04D 29/441; F04D 29/444
See application file for complete search history.

(56) References Cited

U.S. PATENT DOCUMENTS 1,680,775 A * 8/1928 Faber ..... F04D 29/483 415/154.1
5,044,887 A * 9/1991 Duthie ..... F04D 29/281 416/182
5,074,751 A * 12/1991 Sixsmith ..... F04D 29/601 415/206
2005/0214114 A1* 9/2005 Huang ..... F04D 29/667 415/206
2006/0099071 A1* 5/2006 Kao ..... F04D 29/667 415/206
2007/0014666 A1* 1/2007 White ..... F04D 29/422 416/179
2007/0095027 A1* 5/2007 Liva ..... D06F 58/22 55/301
2009/0229141 A1* 9/2009 Nawrot ..... F04D 29/30 34/82
2010/0139112 A1* 6/2010 Atac ..... D06F 58/20 62/3.4
2012/0067347 A1* 3/2012 Bothma ..... A61M 16/0069 128/204.17
2013/0105124 A1* 5/2013 Cheng ..... F04D 29/4206 165/121
2015/0056069 A1* 2/2015 Masutani ..... F04D 17/12 415/184
2018/0051409 A1* 2/2018 Yu ..... D06F 58/20
2021/0388849 A1* 12/2021 Wang ..... F04D 29/582
2022/0228601 A1* 7/2022 Lv ..... F04D 29/281

FOREIGN PATENT DOCUMENTS

CN 207526765 U 6/2018
CN 108386382 A 8/2018
CN 208533192 U 2/2019
CN 210343750 U 4/2020
GB 2057657 A 4/1981
JP 20141656 A 1/2014

* cited by examiner

CENTRIFUGAL FAN AND CLOTHING DRYER

FIELD

The present disclosure belongs to the technical field of fans, and specifically provides a centrifugal fan and a dryer.

BACKGROUND

Based on the principle of converting kinetic energy into potential energy, a centrifugal fan uses a high-speed rotating impeller to accelerate gas, then decelerate it, and change a flow direction thereof, thus converting kinetic energy into potential energy. The centrifugal fan includes a motor, a housing, and an impeller arranged in the housing. The motor can drive the impeller to rotate at a high speed to accelerate the gas. A volute tongue is provided at an air outlet of the housing, and the volute tongue can cut an air flow driven by the impeller so that the air flow is discharged from the air outlet.

In some occasions, the centrifugal fan is required to be able to achieve both forward and reverse rotations. Taking dryers as an example, in order to reduce the cost, existing dryers usually use one motor to simultaneously drive a drying cylinder and the impeller of the centrifugal fan to rotate. In order to solve the problem of entangled clothing in the drying cylinder, the drying cylinder needs to rotate in both forward and reverse directions during the working process of the dryer. When the impeller rotates in the forward direction as the drying cylinder rotates in the forward direction (which is the design direction of the centrifugal fan), the volute tongue can cut the air flow driven by the impeller so that the air flow is discharged from the air outlet. However, when the impeller rotates in the reverse direction as the drying cylinder rotates in the reverse direction (which is opposite to the design direction), the volute tongue cannot cut the air flow driven by the impeller, resulting in a sharp decrease in the air volume discharged from the air outlet, thereby affecting a drying effect on the clothing.

Accordingly, there is a need in the art for a new centrifugal fan and dryer to solve the above problem.

SUMMARY

In order to solve the above problem in the prior art, that is, to solve the problem that the volute tongue of the existing centrifugal fan cannot cut the air flow driven by the impeller when the rotation direction of the impeller is opposite to the design direction, which results in a sharp decrease in the air volume discharged from the centrifugal fan, the present disclosure provides a centrifugal fan, which includes a housing, a driving mechanism, as well as an impeller and a volute tongue that are arranged in the housing, in which the housing is provided with an air inlet and an air outlet, the driving mechanism is connected to the volute tongue and is capable of driving the volute tongue to rotate between a first limit position and a second limit position, and the volute tongue includes a first volute tongue portion and a second volute tongue portion; the impeller is arranged to be capable of suctioning air into the housing from the air inlet when rotating, and the volute tongue is arranged to be capable of cutting the air blown from the impeller and guiding the air to the air outlet when the volute tongue is in the first limit position and the impeller is rotating in a forward direction; the volute tongue is further arranged to be capable of cutting the air blown from the impeller and guiding the air to the air outlet when the volute tongue is in the second limit position and the impeller is rotating in a reverse direction; in which the first limit position is a position where the first volute tongue portion abuts against an inner wall of the housing on one side in a sealingly manner, and the second limit position is a position where the second volute tongue portion abuts against an inner wall of the housing on the other side in a sealingly manner.

In a preferred technical solution of the above centrifugal fan, a first sealing structure is provided on the inner wall of the housing on the one side, and a second sealing structure is provided on the inner wall of the housing on the other side; when the volute tongue is in the first limit position, the first volute tongue portion abuts against the first sealing structure in a sealingly manner, and when the volute tongue is in the second limit position, the second volute tongue portion abuts against the second sealing structure in a sealingly manner.

In a preferred technical solution of the above centrifugal fan, the first sealing structure is a first sealing protrusion formed on the inner wall of the housing on the one side.

In a preferred technical solution of the above centrifugal fan, the second sealing structure is a second sealing protrusion formed on the inner wall of the housing on the other side.

In a preferred technical solution of the above centrifugal fan, the impeller includes a plurality of straight vanes arranged annularly.

In a preferred technical solution of the above centrifugal fan, the plurality of straight vanes are all arranged in a radial direction of the impeller.

In a preferred technical solution of the above centrifugal fan, the impeller includes a plurality of arc-shaped vanes arranged annularly.

In a preferred technical solution of the above centrifugal fan, the driving mechanism includes a driving member and a transmission member, in which the driving member is connected to the housing, the driving member is connected to the volute tongue through the transmission member, and the driving member is capable of driving the transmission member to cause the volute tongue to rotate.

In a preferred technical solution of the above centrifugal fan, the driving member is a motor, the transmission member is a transmission belt, one end of the transmission belt is connected to an output shaft of the motor, and the other end of the transmission belt is connected to the volute tongue.

In another aspect, the present disclosure also provides a dryer, which includes the centrifugal fan described above.

It can be understood by those skilled in the art that in the preferred technical solutions of the present disclosure, a rotatable volute tongue is provided in the housing of the centrifugal fan, the volute tongue includes a first volute tongue portion and a second volute tongue portion, and the volute tongue can rotate between a first limit position and a second limit position; when the volute tongue is in the first limit position and the impeller is rotating in a forward direction, the second volute tongue portion can cut the air blown from the impeller and guide the air to the air outlet; and when the volute tongue is in the second limit position and the impeller is rotating in a reverse direction, the first volute tongue portion can cut the air blown from the impeller and guide the air to the air outlet. Through such an arrangement, it can be ensured that the centrifugal fan has a sufficient amount of air when the impeller rotates either in the forward direction or in the reverse direction; moreover, when the volute tongue is in the first limit position, the first volute tongue portion abuts against the inner wall of the housing on one side in a sealingly manner, thereby preventing air from flowing back along the inner wall on this side; and similarly, when the volute tongue is in the second limit position, the second volute tongue portion abuts against the inner wall of the housing on the other side in a sealingly manner, thereby preventing air from flowing back along the inner wall on this side and improving the stability of air flow.

Further, a first sealing structure is provided on the inner wall of the housing on one side, and a second sealing structure is provided on the inner wall of the housing on the other side; when the volute tongue is in the first limit position, the first volute tongue portion abuts against the first sealing structure in a sealingly manner, and when the volute tongue is in the second limit position, the second volute tongue portion abuts against the second sealing structure in a sealingly manner. By providing the first sealing structure on the inner wall of the housing on the one side such that the first volute tongue portion abuts against the first sealing structure in a sealingly manner, the sealingness between the first volute tongue portion and the inner wall on this side can be improved. Similarly, by providing the second sealing structure on the inner wall of the housing on the other side such that the second volute tongue portion abuts against the second sealing structure in a sealingly manner, the sealingness between the second volute tongue portion and the inner wall on this side can be improved.

Further, a plurality of straight vanes are arranged in the radial direction of the impeller. Through such an arrangement, the centrifugal fan can blow out the same amount of air when the impeller rotates either in the forward direction or in the reverse direction.

In addition, the dryer further provided by the present disclosure on the basis of the above technical solutions, due to the employment of the above centrifugal fan, has the technical effects of the above centrifugal fan. As compared with the dryer before improvement, the dryer of the present disclosure can provide a sufficient amount of air when the drying cylinder rotates either in the forward direction or in the reverse direction, thereby improving the drying effect on the clothing.

BRIEF DESCRIPTION OF DRAWINGS

Preferred embodiments of the present disclosure will be described below with reference to the accompanying drawings, in which.

DETAILED DESCRIPTION

First, it should be understood by those skilled in the art that the embodiments described below are only used to explain the technical principles of the present disclosure, and are not intended to limit the scope of protection of the present disclosure.

It should be noted that in the description of the present disclosure, terms indicating directional or positional relationships, such as "upper", "lower", "top", "bottom", "inner", "outer", "clockwise", "counterclockwise" and the like, are based on the directional or positional relationships shown in the accompanying drawings. They are only used for ease of description, and do not indicate or imply that the device or element must have a specific orientation, or be constructed or operated in a specific orientation. Therefore, they should not be considered as limitations to the present disclosure. In addition, terms "first" and "second" are merely used for description, and should not be construed as indicating or implying relative importance.

In addition, it should also be noted that in the description of the present disclosure, unless otherwise clearly specified and defined, terms "install", "arrange", "connect" and "connection" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be an internal communication between two elements. For those skilled in the art, the specific meaning of the above terms in the present disclosure can be understood according to specific situations.

Based on the problem pointed out in the "BACKGROUND" that the volute tongue of the existing centrifugal fan cannot cut the air flow driven by the impeller when the rotation direction of the impeller is opposite to the design direction, which results in a sharp decrease in the air volume discharged from the centrifugal fan, the present disclosure provides a centrifugal fan and a dryer, aiming at enabling the volute tongue of the centrifugal fan to cut the air flow driven by the impeller when the impeller rotates either in the forward direction or in the reverse direction and guaranteeing the demand on the air volume.

Figure 1:
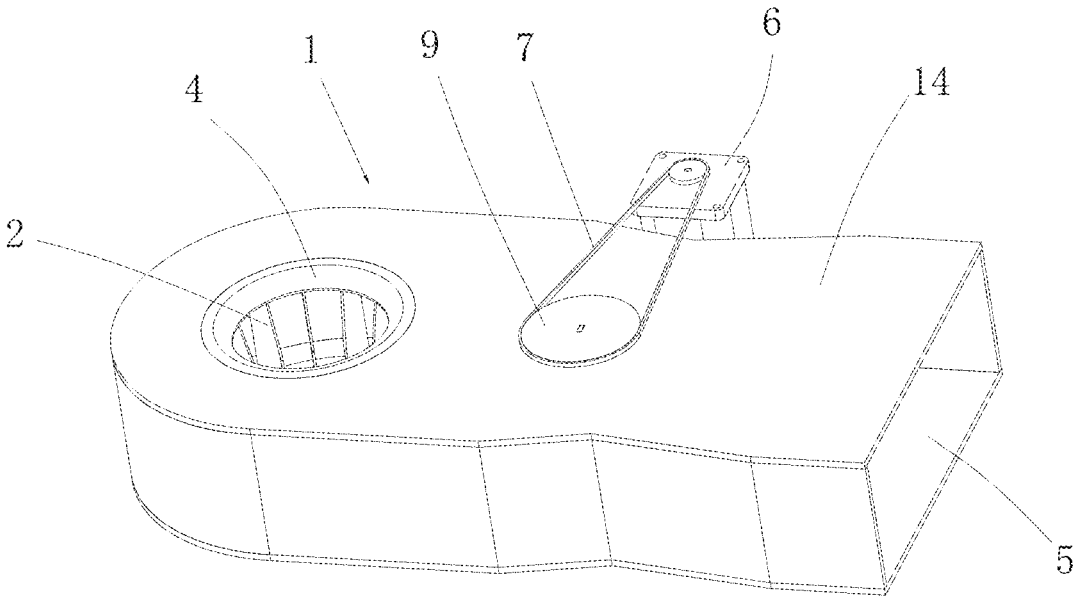
FIG. 1 is a first schematic structural view of a centrifugal fan of the present disclosure.
Figure 2:
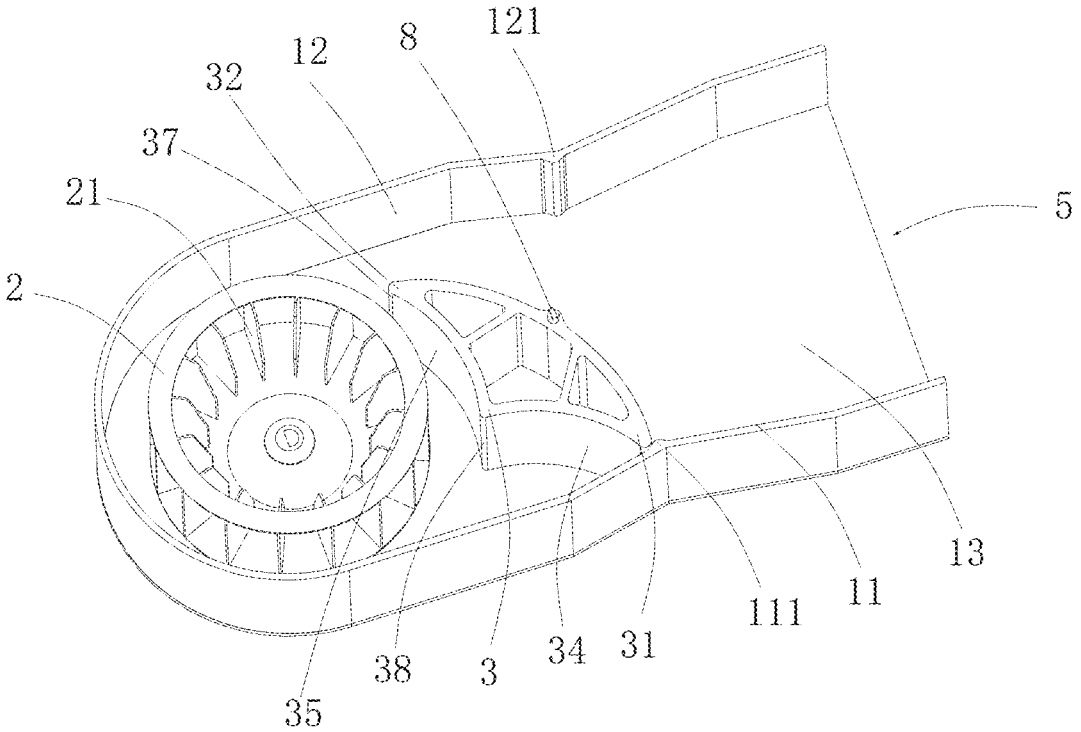
FIG. 2 is a second schematic structural view of the centrifugal fan of the present disclosure.
Figure 3:
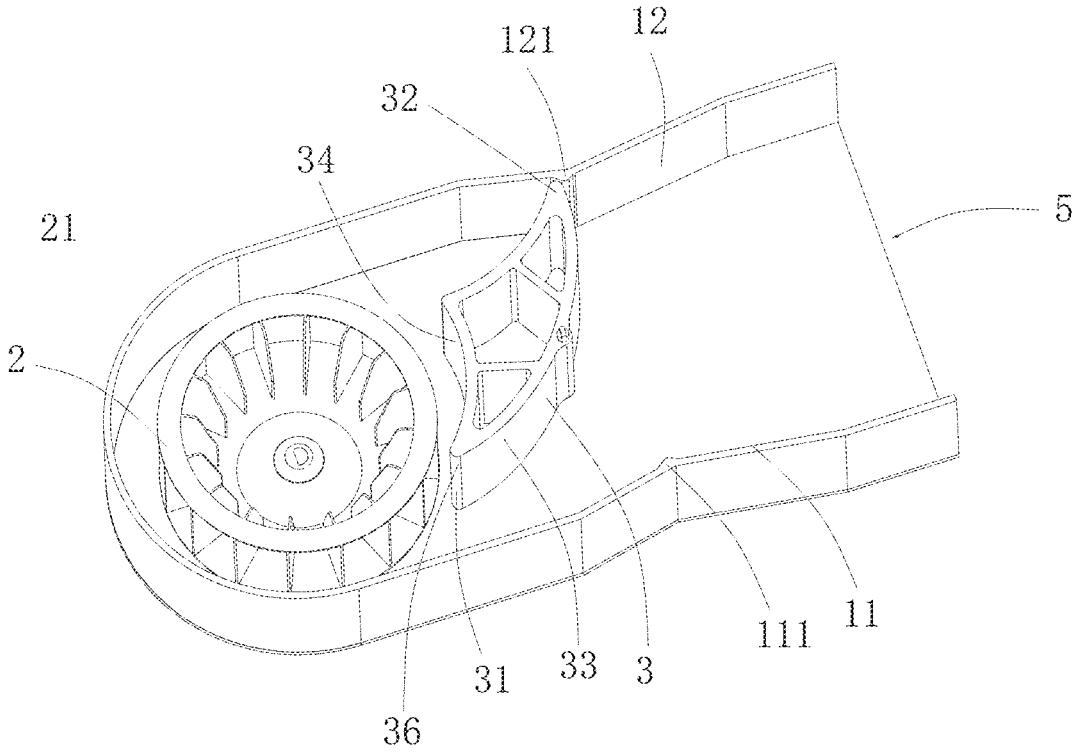
FIG. 3 is a third schematic structural view of the centrifugal fan of the present disclosure.
Figure 4:
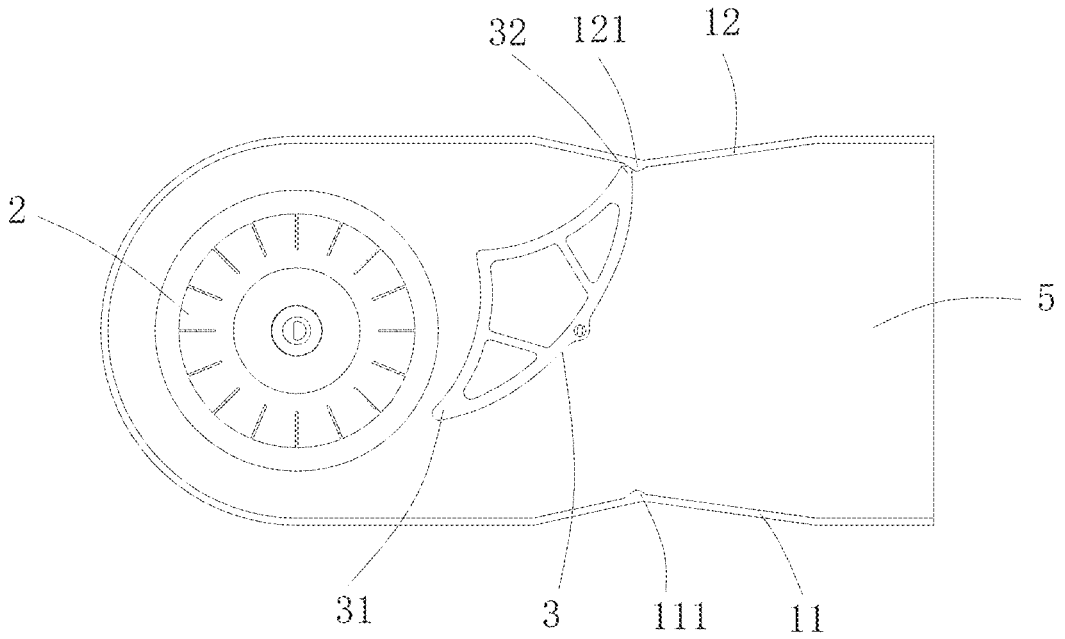
FIG. 4 is a fourth schematic structural view of the centrifugal fan of the present disclosure.
Figure 5:
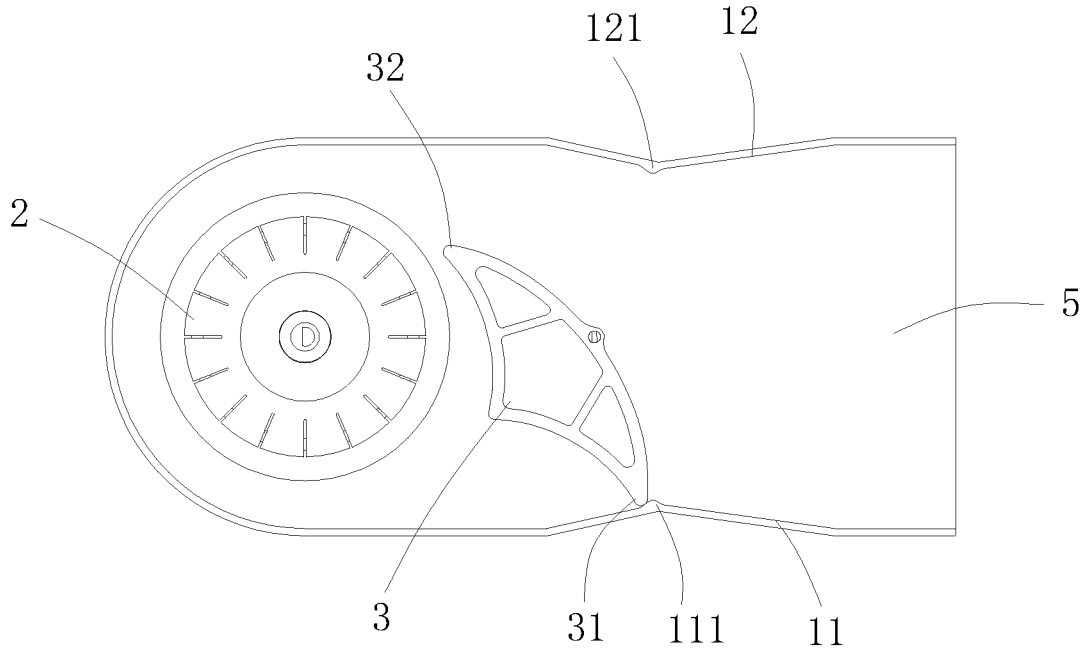
FIG. 5 is a fifth schematic structural view of the centrifugal fan of the present disclosure.

Specifically, as shown in FIGS. 1 to 3, the centrifugal fan of the present disclosure includes a housing 1, a driving mechanism, as well as an impeller 2 and a volute tongue 3 that are arranged in the housing 1. The housing 1 is provided with an air inlet 4 and an air outlet 5, the driving mechanism is connected to the volute tongue 3 and is capable of driving the volute tongue 3 to rotate between a first limit position and a second limit position, and the volute tongue 3 includes a first volute tongue portion 31 and a second volute tongue portion 32; the impeller 2 is arranged to be capable of suctioning air into the housing 1 from the air inlet 4 when rotating, and the volute tongue 3 is arranged to be capable of cutting the air blown from the impeller 2 and guiding the air to the air outlet 5 when the volute tongue 3 is in the first limit position and the impeller 2 is rotating in a forward direction; the volute tongue 3 is further arranged to be capable of cutting the air blown from the impeller 2 and guiding the air to the air outlet 5 when the volute tongue 3 is in the second limit position and the impeller 2 is rotating in a reverse direction; in which the first limit position is a position where the first volute tongue portion 31 abuts against an inner wall of the housing 1 on one side in a sealingly manner, and the second limit position is a position where the second volute tongue portion 32 abuts against an inner wall of the housing 1 on the other side in a sealingly manner Specifically, the volute tongue 3 shown in FIG. 2 is in the first limit position. At this time, the first volute tongue portion 31 abuts against a first-side inner wall 11 of the housing 1 in a sealingly manner; when the impeller 2 rotates in a forward direction (rotating clockwise when viewed from the figure), the second volute tongue portion 32 can cut the air blown from the impeller 2 and guide the air to the air outlet 5. Moreover, since the first volute tongue portion 31 abuts against the first-side inner wall 11 of the housing 1 in a sealingly manner, air can be prevented from flowing back along the first-side inner wall 11. The volute tongue 3 shown in FIG. 3 is in the second limit position. At this time, the second volute tongue portion 32 abuts against a second-side inner wall 12 of the housing 1 in a sealingly manner; when the impeller 2 rotates in a reverse direction (rotating counterclockwise when viewed from the figure), the first volute tongue portion 31 can cut the air blown from the impeller 2 and guide the air to the air outlet 5. Moreover, since the second volute tongue portion 32 abuts against the second-side inner wall 12 of the housing 1 in a sealingly manner, air can be prevented from flowing back along the second-side inner wall 12. By adjusting the position of the volute tongue 3, it can be ensured that the centrifugal fan has a sufficient amount of air when the impeller 2 rotates either in the forward direction or in the reverse direction. The volute tongue 3 can be driven by the driving mechanism to rotate from the first limit position to the second limit position. The driving mechanism may be provided as a hydraulic driving mechanism or a motor driving mechanism. Such adjustments and changes to the specific type and structural form of the driving mechanism do not deviate from the principle and scope of the present disclosure, and should be defined within the scope of protection of the present disclosure.

In addition, it should be noted that when the volute tongue 3 is in the first limit position or the second limit position, the volute tongue 3 needs to be fixed and stationary under the impact of the airflow. In a possible situation, the driving mechanism has a locking function. For example, the driving mechanism may be a self-locking motor, and the locking can be realized by self-locking of the motor. That is, after the driving mechanism drives the volute tongue 3 to rotate to the first limit position, the volute tongue 3 can be fixed and stationary at the first limit position. Similarly, after the driving mechanism drives the volute tongue 3 to rotate to the second limit position, the volute tongue 3 can be fixed and stationary at the second limit position. In another possible situation, a magnetic attraction structure is provided on the volute tongue 3 and/or inner side walls of the housing 1. When the volute tongue 3 is in the first limit position, the first volute tongue portion 31 is attracted onto the first-side inner wall 11 of the housing 1 by the magnetic attraction structure. Similarly, when the volute tongue 3 is in the second limit position, the second volute tongue portion 32 is attracted onto the second-side inner wall 12 of the housing 1 by the magnetic attraction structure. Of course, the above two situations are only exemplary, and should not be considered as constituting limitations to the present disclosure.

With reference to FIGS. 2 and 3, the volute tongue 3 has a periphery including a first curve surface 33, a second curve surface 34 connected to the first curve surface 33 at a first side edge 36, and a third curve surface 35 connected to the first curve surface 33 at a second side edge 37 and to the second curve surface 34 at a third side edge 38. The first side edge 36 and the second side edge 37 are positioned on the opposite sides of the first curve surface 33. The third side edge 38 is positioned between the first curve surface 33 and the impeller 2, and the rotating shaft 8 is positioned adjacent to the middle of the first curve surface 33. The first curve surface 33 protrudes away from the impeller 2 and both the second curve surface 34 and the third curve surface 35 protrude towards the first curve surface 33. The first volute tongue portion 31 abuts against the first-side inner wall 11 of the housing 1 via the first side edge 36, and the second volute tongue portion 32 abuts against the second-side inner wall 12 of the housing 1 via the second side edge 37.

Preferably, as shown in FIGS. 1 and 2, the driving mechanism includes a driving member 6 and a transmission member 7. The driving member 6 is connected to the housing 1, and the driving member 6 is connected to the volute tongue 3 through the driving member 7. The driving member 6 can drive the transmission member 7 to cause the volute tongue 3 to rotate. The driving member 6 is a motor, and the transmission member 7 is a transmission belt, with one end of the transmission belt being connected to an output shaft of the motor, and the other end of the transmission belt being connected to the volute tongue 3. In a possible situation, a rotating shaft 8 is provided on the volute tongue 3, with a bottom of the rotating shaft 8 being rotatably connected to a bottom plate 13 of the housing 1, and a top of the rotating shaft 8 being rotatably connected to a top plate 14 of the housing 1. The top of the rotating shaft 8 is provided with a rotating disc 9, one end of the transmission belt is connected to the output shaft of the motor, and the other end of the transmission belt is connected to the rotating disc 9. The motor drives the transmission belt to move, the transmission belt drives the rotating disc 9 to rotate, and the rotating disc 9 drives the rotating shaft 8 to rotate. In another possible situation, the top of the volute tongue 3 is provided with a first rotating shaft, the bottom plate 13 of the housing 1 is provided with a second rotating shaft, and the bottom of the volute tongue 3 is provided with a shaft hole adapted to the second rotating shaft. One end of the transmission belt is connected to the output shaft of the motor, and the other end of the transmission belt is connected to the first rotating shaft. The motor drives the transmission belt to move, the transmission belt drives the first rotating shaft to rotate, and the first rotating shaft drives the volute tongue 3 to rotate. The above two situations are only exemplary, and should not be considered as constituting limitations to the present disclosure. In addition, the transmission member 7 may also be provided as other transmission structures such as gears. Such adjustments and changes to the specific structural form of the transmission member 7 do not deviate from the principle and scope of the present disclosure, and should be defined within the scope of protection of the present disclosure.

Preferably, as shown in FIGS. 2 to 5, a first sealing structure is provided on the inner wall the housing 1 on one side, and a second sealing structure is provided on the inner wall of the housing 1 on the other side; when the volute tongue 3 is in the first limit position, the first volute tongue portion 31 abuts against the first sealing structure in a sealingly manner, and when the volute tongue 3 is in the second limit position, the second volute tongue portion 32 abuts against the second sealing structure in a sealingly manner. The first sealing structure is provided on the first-side inner wall 11 of the housing 1, and the first sealing structure is a first sealing protrusion 111 formed on the first-side inner wall 11. When the volute tongue 3 is in the first limit position, the first volute tongue portion 31 abuts against the first sealing protrusion 111 in a sealingly manner. The second sealing structure is provided on the second-side inner wall 12 of the housing 1, and the second sealing structure is a second sealing protrusion 121 formed on the second-side inner wall 12. When the volute tongue 3 is in the second limit position, the second volute tongue portion 32 abuts against the second sealing protrusion 121 in a sealingly manner. Of course, the first sealing structure may also be provided as a structure such as a sealing plate or a sealing rib fixed on the first-side inner wall 11. Similarly, the second sealing structure may also be provided as a structure such as a sealing plate or a sealing rib fixed on the second-side inner wall 12. Such adjustments and changes to the specific structural form of the first sealing structure and the second sealing structure do not deviate from the principle and scope of the present disclosure, and should be defined within the scope of protection of the present disclosure.

Figure 6:
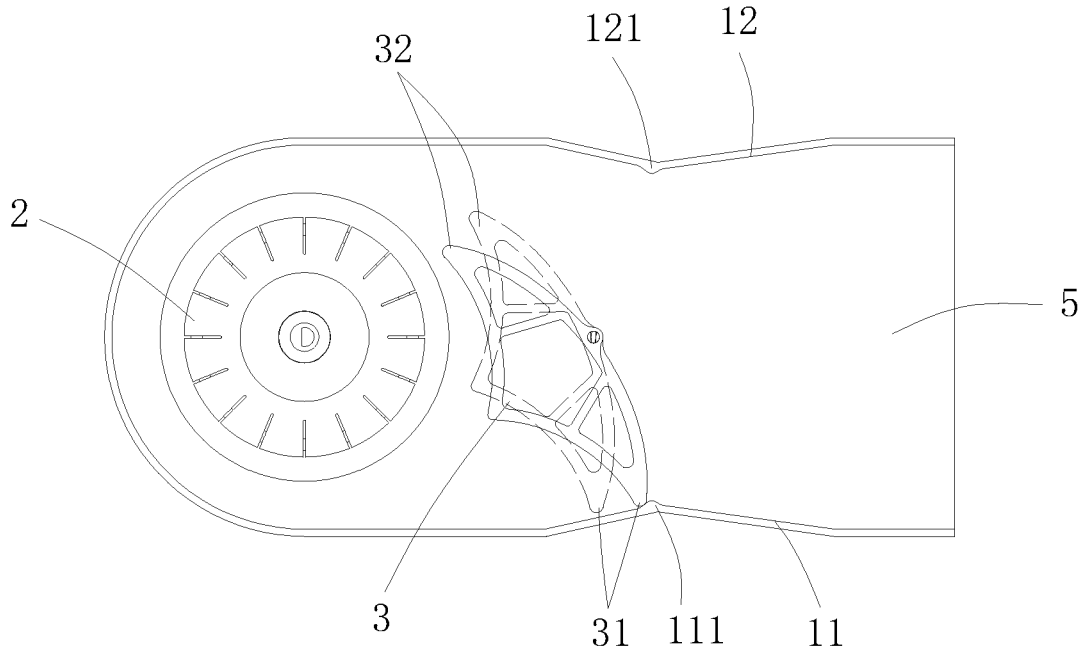
FIG. 6 is a sixth schematic structural view of the centrifugal fan of the present disclosure.

In addition, it should be noted that in practical applications, in addition to maintaining the volute tongue 3 at the first limit position and the second limit position, the volute tongue 3 may also be maintained at a certain position between the first limit position and the second limit position under some special requirements. For example, as shown in FIG. 6, the volute tongue 3 is located between the first limit position and the second limit position at this time, and when the volute tongue 3 is in this position (the position where the volute tongue 3 in dashed lines is located in FIG. 6), a distance between the second volute tongue portion 32 and the impeller 2 is increased as compared with the distance between the second volute tongue portion 32 and the impeller 2 when the volute tongue 3 is in the first limit position. Therefore, the cutting effect of the second volute tongue portion 32 on the air flow is weakened, thereby reducing the noise. Of course, the air volume will also decrease correspondingly, which is therefore suitable for applications that require a small air volume. It should be noted that the volute tongue 3 can be maintained at any position between the first limit position and the second limit position through the self-locking of the motor.

Preferably, as shown in FIGS. 2 and 3, the impeller 2 includes a plurality of straight vanes 21 arranged annularly. In a preferred situation, the plurality of straight vanes 21 are all arranged in a radial direction of the impeller 2. Through such an arrangement, the centrifugal fan can blow out the same amount of air when the impeller 2 rotates either in the forward direction or in the reverse direction. Of course, in practical applications, according to specific conditions, the plurality of straight vanes 21 may also be set to form a specific included angle with the radial direction of the impeller 2. Such flexible adjustments and changes do not deviate from the principle and scope of the present disclosure, and should be defined within the scope of protection of the present disclosure.

Figure 7:
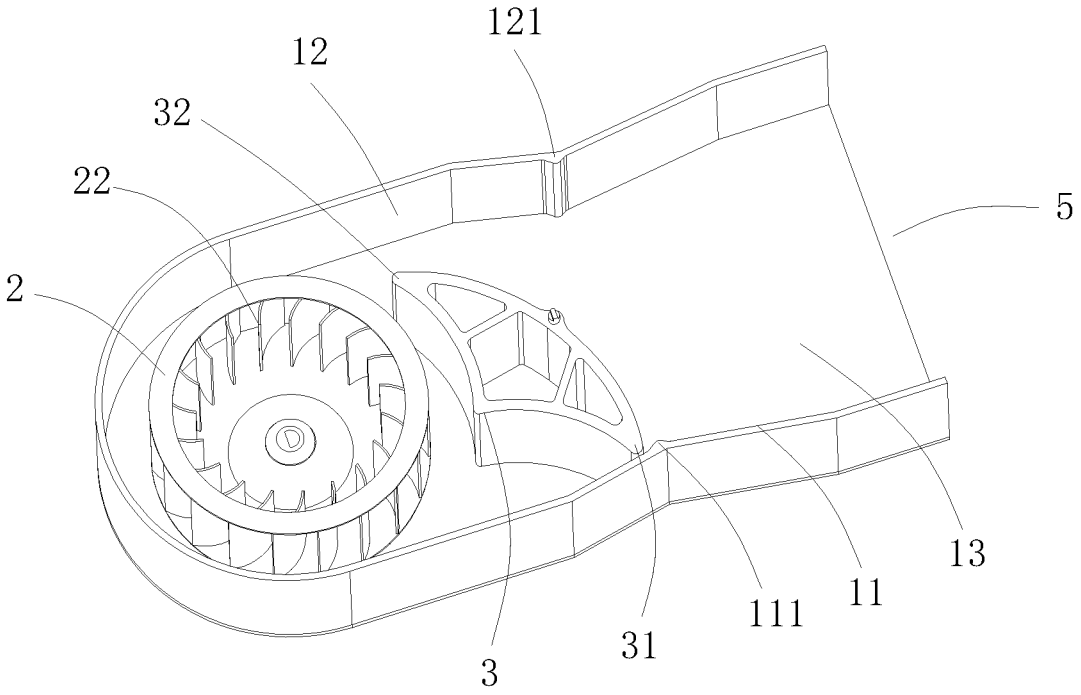
FIG. 7 is a seventh schematic structural view of the centrifugal fan of the present disclosure.
Figure 8:
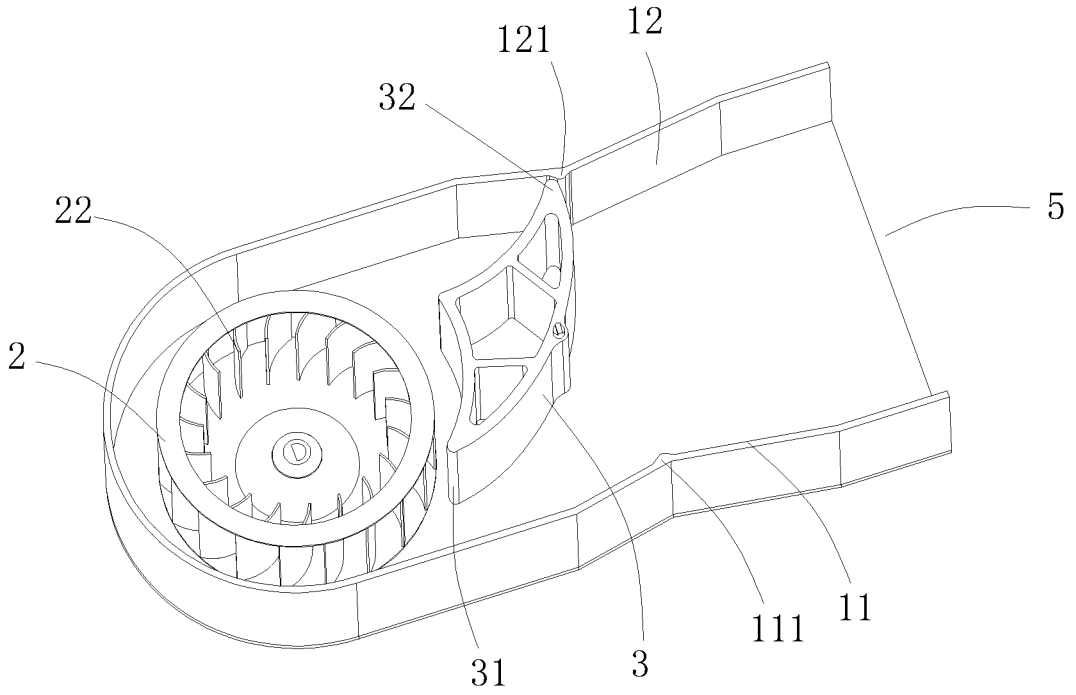
FIG. 8 is an eighth schematic structural view of the centrifugal fan of the present disclosure.

Preferably, as shown in FIGS. 7 and 8, the impeller 2 includes a plurality of arc-shaped vanes 22 arranged annularly. In this case, the forward and reverse rotations of the impeller 2 can bring about two working modes, one of which is focused on performance, and the other of which is focused on efficiency. For example, in the arrangement of FIG. 7, when the impeller 2 rotates in the forward direction (rotating clockwise when viewed from the figure), an outlet angle of the arc-shaped vane 22 faces the direction of rotationally blowing-out wind. At this time, the impeller 2 works in the forward vane mode, and the impeller 2 can provide a greater air flow pressure. When the impeller 2 rotates in the reverse direction (rotating counterclockwise when viewed from the figure), as shown in FIG. 8, the outlet angle of the arc-shaped vane 22 is opposite to the direction of rotationally blowing-out wind. The impeller 2 works in the reverse vane mode, and the air flow pressure that the impeller 2 can provide is less than that in the forward vane mode. However, this work mode can provide higher aerodynamic efficiency.

It should be noted that the specific shape of the vane is not limited to the above-mentioned straight vanes and arc-shaped vanes, and the vanes may also be configured into other shapes. For example, the vanes may also be provided as "V"-shaped vanes or "L"-shaped vanes, etc. Such adjustments and changes to the specific shape of the vanes do not deviate from the principle and scope of the present disclosure, and should be defined within the scope of protection of the present disclosure.

Finally, the present disclosure also provides a dryer, which includes the centrifugal fan described above.

Hitherto, the technical solutions of the present disclosure have been described in conjunction with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A centrifugal fan, comprising:

a housing, a driving mechanism, an impeller arranged in the housing, and a volute tongue arranged in the housing and having a rotating shaft, wherein the housing is provided with an air inlet and an air outlet, the driving mechanism is connected to the volute tongue via the rotating shaft and is capable of driving the volute tongue to rotate between a first limit position and a second limit position, and the volute tongue comprises a first volute tongue portion and a second volute tongue portion;

wherein the volute tongue has a periphery including a first curve surface, a second curve surface connected to the first curve surface at a first side edge, and a third curve surface connected to the first curve surface at a second side edge and to the second curve surface at a third side edge;

wherein the first side edge and the second side edge are positioned on opposite sides of the first curve surface, the third side edge is positioned between the first curve surface and the impeller, and the rotating shaft is positioned adjacent to the middle of the first curve surface;

wherein the first curve surface protrudes away from the impeller and both the second curve surface and the third curve surface protrude towards the first curve surface;

wherein the impeller is arranged to be capable of suctioning air into the housing from the air inlet when rotating, and the volute tongue is arranged to be capable of cutting the air blown from the impeller and guiding the air to the air outlet when the volute tongue is in the first limit position and the impeller is rotating in a forward direction; and wherein the volute tongue is further arranged to be capable of cutting the air blown from the impeller and guiding the air to the air outlet when the volute tongue is in the second limit position and the impeller is rotating in a reverse direction; and wherein the first limit position is a position where the first volute tongue portion abuts against an inner wall of the housing via the first side edge on one side in a sealingly manner, and the second limit position is a position where the second volute tongue portion abuts against an inner wall of the housing on the other side in a sealingly manner.

2. The centrifugal fan according to claim 1, wherein a first sealing structure is provided on the inner wall of the housing on one side, and a second sealing structure is provided on the inner wall of the housing on the other side; and wherein when the volute tongue is in the first limit position, the first volute tongue portion abuts against the first sealing structure in a sealingly manner, and when the volute tongue is in the second limit position, the second volute tongue portion abuts against the second sealing structure in a sealingly manner.

3. The centrifugal fan according to claim 2, wherein the first sealing structure is a first sealing protrusion formed on the inner wall of the housing on the one side.

4. The centrifugal fan according to claim 2, wherein the second sealing structure is a second sealing protrusion formed on the inner wall of the housing on the other side.

5. The centrifugal fan according to claim 1, wherein the impeller comprises a plurality of straight vanes arranged annularly.

6. The centrifugal fan according to claim 5, wherein the plurality of straight vanes are all arranged in a radial direction of the impeller.

7. The centrifugal fan according to claim 1, wherein the impeller comprises a plurality of arc-shaped vanes arranged annularly.

8. The centrifugal fan according to claim 1, wherein the driving mechanism comprises a driving member and a transmission member, the driving member is connected to the housing, the driving member is connected to the volute tongue through the transmission member, and the driving member is capable of driving the transmission member to cause the volute tongue to rotate.

9. The centrifugal fan according to claim 8, wherein the driving member is a motor, the transmission member is a transmission belt, one end of the transmission belt is connected to an output shaft of the motor, and the other end of the transmission belt is connected to the volute tongue.

10. A dryer, comprising the centrifugal fan according to claim 1.

* * * * *